US005967375A

United States Patent [19]

Barnes

[11] Patent Number: 5,967,375

[45] Date of Patent: Oct. 19, 1999

[54] SEALANT MELTER WITH RETROFITTABLE SEALANT BLOCK FEED ASSEMBLY

[75] Inventor: David W. Barnes, Gilbert, Ariz.

[73] Assignee: Crafco, Inc., Chandler, Ariz.

[21] Appl. No.: 08/908,389

[22] Filed: Aug. 7, 1997

[51] Int. Cl.[6] ..... B67D 5/62

[52] U.S. Cl. ..... 222/146.2; 222/108; 222/608; 193/3; 414/196; 414/519; 220/263

[58] Field of Search ..... 222/146.2, 146.4, 222/146.5, 108, 109, 111, 608, 612, 626; 141/82, 231; 414/157, 196, 519, 520; 193/3; 239/130; 220/259, 263

[56] References Cited

U.S. PATENT DOCUMENTS

| | | | |
|---|---|---|---|
| Re. 26,786 | 2/1970 | Plumb | 222/146.2 |
| 1,689,057 | 10/1928 | Schwemlein | 220/263 |
| 1,720,677 | 7/1929 | Howlett | 193/3 |
| 2,235,324 | 3/1941 | Moreland | 222/146.4 |
| 2,630,242 | 3/1953 | Muller | 220/263 |
| 2,816,692 | 12/1957 | Schade | 222/608 |
| 3,106,344 | 10/1963 | Baird, Jr. et al. | 222/146.2 |
| 3,952,921 | 4/1976 | Tanner | 222/146.5 |
| 4,184,522 | 1/1980 | Waite | 141/231 |
| 4,625,888 | 12/1986 | Thompson | 220/263 |
| 4,793,512 | 12/1988 | Krauss | 222/77 |
| 4,887,741 | 12/1989 | Downing | 222/146.5 |
| 4,887,908 | 12/1989 | Montgomery et al. | 222/146.2 |
| 5,450,984 | 9/1995 | Rihr | 222/77 |
| 5,586,678 | 12/1996 | Rosch et al. | 220/263 |

OTHER PUBLICATIONS

Super Shot 60, Crafco Inc.
Specifications for the LF–150, Crafco Inc., 2 pages.
BAX 250 Bitumen Applicator, Crafco Inc., 2 pages.
Assembly drawing for Front Loading Conveyor Package, Crafco Inc., 1985.

*Primary Examiner*—J. Casimer Jacyna
*Attorney, Agent, or Firm*—Nilles & Nilles, S.C.

[57] ABSTRACT

A sealant melter incorporates a sealant block feed assembly that reduces the labor required to feed sealant blocks to the sealant tank of the melter and that reduces or even eliminates the risk that hot liquid sealant will splash out of the sealant tank when sealant blocks are fed into it. The sealant block feed assembly preferably includes a top-fed splash box and a conveyor assembly for feeding sealant blocks to the splash box from a towing/storage vehicle or the like. The splash box incorporates internal guards in the form of counterbalanced flaps that prevent hot liquid sealant from splashing out of the splash box when the sealant blocks are fed into it from above. The conveyor assembly includes a conveyor that is selectively controllable, either from the towing/storage vehicle or from curbside, to receive sealant blocks and to selectively feed the received sealant blocks to the splash box. The height and/or the length of the conveyor can be varied to meet the needs of a particular towing/storage vehicle, and the entire sealant block feed assembly is configured for detachably mounting on the sealant melter frame so as to be easily retrofittable on a previously-assembled sealant melter.

23 Claims, 8 Drawing Sheets

SEALANT MELTER WITH RETROFITTABLE SEALANT BLOCK FEED ASSEMBLY

BACKGROUND OF THE INVENTION

1. Field of the Invention

The invention relates to sealant melters and, more particularly, relates to a sealant melter having a sealant block feed assembly for the controlled delivery of sealant blocks to a heated sealant tank of the sealant melter without splashing and to a retrofittable sealant block feed assembly usable with a sealant melter.

2. Discussion of the Related Art

Sealant melters are well-known for use in conjunction with applicators that apply a viscous hot liquid sealant to joints or cracks in concrete, asphalt, or the like. The typical sealant melter includes a mobile frame (typically a trailer) on which is mounted a melter and an applicator. The applicator typically takes the form of a wand or nozzle. The melter typically takes the form of a sealant tank and a liquid fuel-fired heater mounted on the frame adjacent the sealant tank and operable to supply heat to the sealant tank. The heated sealant tank melts blocks of sealant and stores the hot liquid sealant for subsequent dispensation to the applicator.

Feeding sealant blocks to the traditional sealant melter is a labor-intensive task that places operators at risk of being splattered by sealant splashing from the sealant tank. Sealant blocks typically are delivered to a worksite by a towing/storage vehicle (typically a dump truck, flatbed truck, or the like) that hauls the sealant blocks and that also tows the trailer. Solid sealant blocks, typically weighing about 30 lbs, are delivered one at a time from a first operator stationed on the towing/storage vehicle to a second operator stationed on the ground. The second operator then delivers the sealant blocks one at a time through an upper inlet in the sealant tank. This inlet typically is located at or near the level of the second operator's head. The second operator therefore must expend substantial effort in delivering sealant blocks to the sealant tank. If the sealant tank is nearly full, hot sealant (on the order of 500° F.) may splash out of the sealant tank upon the ingress of the sealant blocks and splatter on the surrounding area and even on the second operator.

Hence, there is a need for a sealant block feed assembly that is usable with a sealant melter and that facilitates the supply of sealant blocks to the sealant tank.

One prior attempted solution to this problem involved the use of an unpowered gravity-feed roller conveyor that led from the towing/storage vehicle to a receptacle on the sealant tank. The receptacle took the form of a box having an inlet in one of its vertical sides. The roller conveyor sloped downwardly from the towing/storage vehicle to the side inlet of the receptacle so that sealant blocks placed on its upper end slid by gravity into the side inlet of the receptacle.

The sealant block feed assembly using an unpowered conveyor and a side-fed receptacle proved imperfect. The receptacle may have helped reduce splashing, but its front or side inlet terminated so close to the inlet opening of the sealant tank that it could not assuredly prevent liquid sealant from splashing out of the sealant tank upon sealant block ingress. Moreover, there was no practical way to arrest sealant block movement along the conveyor and hence no way to prevent sealant blocks from sliding into the receptacle once they were placed on the conveyor. Sealant blocks therefore could not be loaded in batches by a single operator and then subsequently fed one at a time into the sealant tank from curbside but instead needed to be fed to the receptacle one at a time by an operator stationed on the vehicle. In addition, the sealant block feed assembly was difficult to retrofit onto previously-assembled sealant melters.

OBJECTS AND SUMMARY OF THE INVENTION

It is therefore a principal object of the invention to provide a sealant melter incorporating a sealant block feed assembly that facilitates the supply of sealant blocks to the heated sealant tank of a sealant melter while reducing risk to the operator.

Another object of the invention is to provide a sealant melter that meets the first object of the invention and that requires less labor for its operation than typical prior art sealant melters.

Still another object of the invention is to provide a sealant melter which meets one or more of the foregoing objects and the sealant block feed assembly which can be retrofitted onto a previously-assembled sealant melter.

In accordance with a first aspect of the invention, these objects are achieved by providing a sealant melter comprising a mobile frame, a heated sealant tank mounted on the frame, the sealant tank having a liquid sealant discharge opening and an upper sealant block inlet opening, and a splash box disposed above the inlet opening of the sealant tank. The splash box has an upper splash box inlet and a lower splash box outlet disposed above the inlet opening of the sealant tank.

Sealant block transfer can be facilitated by using a sealant block conveyor to convey sealant blocks from a source to the splash box inlet. The conveyor is preferably a powered conveyor controlled by a conveyor control assembly which is mounted on the inlet end of the sealant block conveyor and which includes a manually-operated ON button which, when actuated, causes motive power to be supplied to the sealant block conveyor. Preferably, the control assembly additionally includes a second manually-operated ON button which is located remotely from the first ON button and which, when actuated, causes motive power to be supplied to the sealant block conveyor.

The splash box preferably includes a splash guard which is located above the splash box outlet and which 1) automatically opens upon sealant block ingress to permit passage of a sealant block therethrough and 2) automatically closes upon sealant block egress to prevent liquid sealant from splashing out of the splash box. The splash guard may comprise a pair of flaps and a return mechanism. The flaps are mounted on the splash box so as to be pivotable about a horizontal axis 1) from a closed position in which they extend generally horizontally towards one another and separate the splash box inlet from the splash box outlet 2) to an open position in which they extend at an angle with respect to the horizontal and permit passage of the sealant blocks therepast. The return mechanism biases the flaps towards the closed position and preferably comprises a pair of counterweights, each of which is coupled to a respective one of the flaps.

Yet another object of the invention is to provide a sealant melter that meets one or more of the foregoing objects of the invention and that can be easily adjusted or adapted for use with different towing/storage vehicles.

This object is achieved by rendering at least the inlet end of the sealant block conveyor vertically adjustable relative to the frame. Vertical adjustment may be effected via a telescoping support comprising 1) a pair of laterally spaced, generally vertically-extending outer members, 2) a pair of laterally spaced, generally vertically-extending inner members each of which slidably mates with one of the outer members, and 3) a plurality of connectors detachably connecting the inner members to the outer members.

These and other objects, features, and advantages of the present invention will become apparent from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Resume

Pursuant to the invention, a sealant melter is provided which incorporates a sealant block feed assembly that reduces the labor required to feed sealant blocks to the sealant tank of the melter and that reduces or even eliminates the risk that hot liquid sealant will splash out of the sealant tank when sealant blocks are fed into it. The sealant block feed assembly preferably includes a top-fed splash box and a conveyor assembly for feeding sealant blocks to the splash box from a towing/storage vehicle or the like. The splash box incorporates internal guards in the form of counterbalanced flaps that prevent hot liquid sealant from splashing out of the splash box when the sealant blocks are fed into it from above. The conveyor assembly includes a conveyor that is selectively controllable, either from the towing/storage vehicle or from curbside, to receive sealant blocks and to selectively feed the received sealant blocks to the splash box. The height and/or the length of the conveyor can be varied to meet the needs of a particular towing/storage vehicle, and the entire sealant block feed assembly is configured for detachably mounting on the sealant melter frame so as to be easily retrofittable on a previously-assembled sealant melter.

2. System Overview

Figure 1:
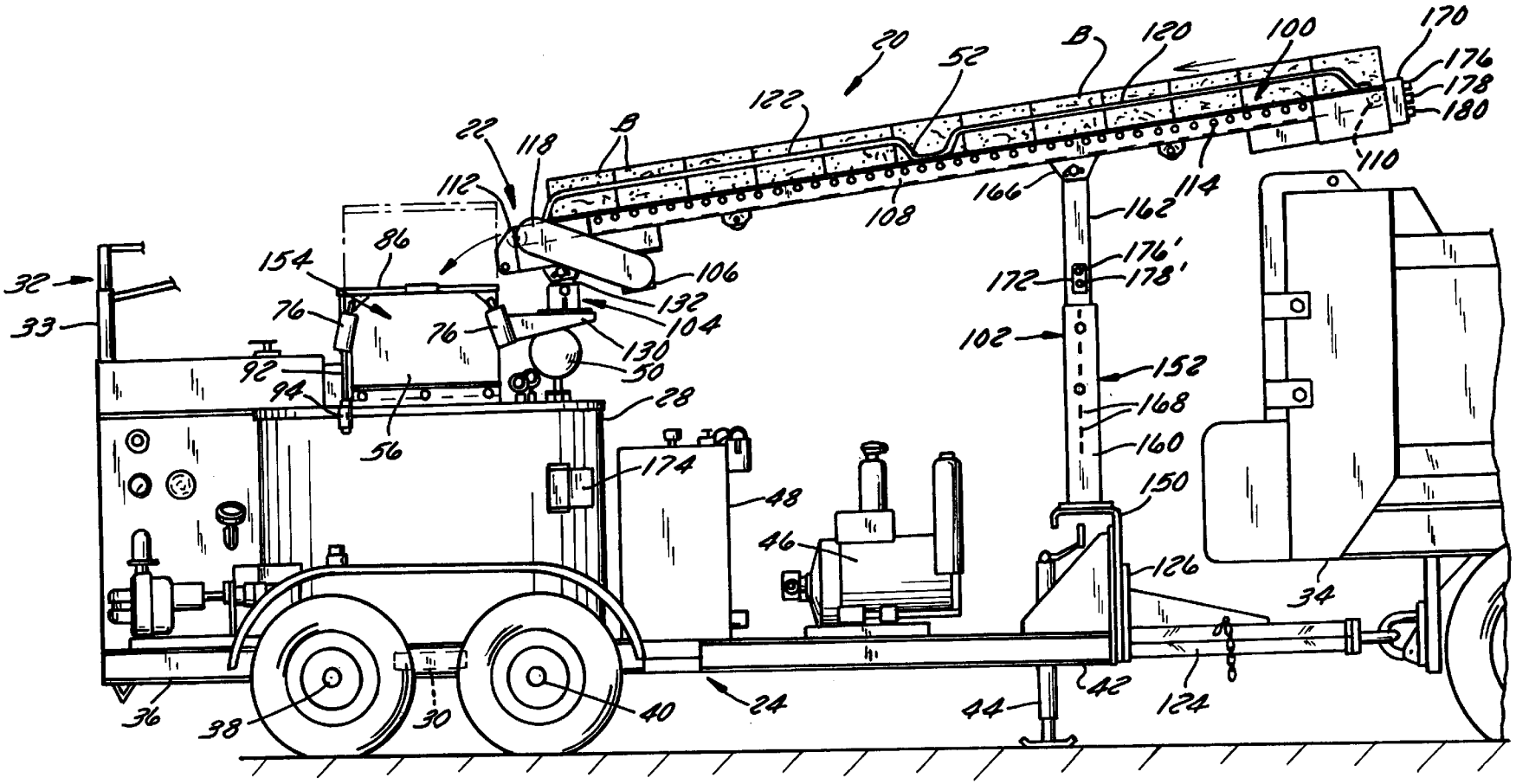
FIG. 1 is a side elevation view of a sealant melter constructed in accordance with a preferred embodiment of the invention along with a portion of an associated towing/storage vehicle.
Figure 2:
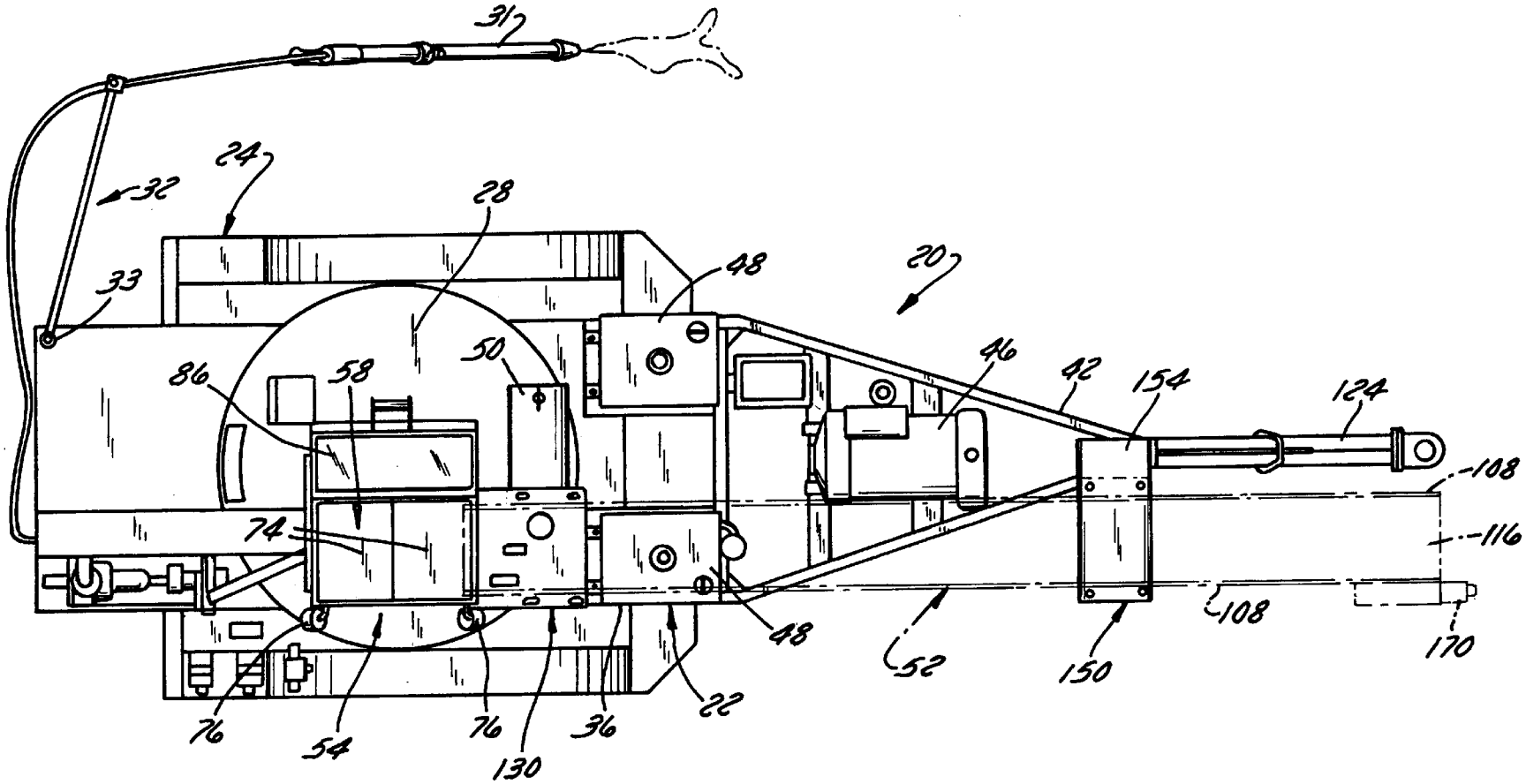
FIG. 2 is a top plan view of the sealant melter of FIG. 1.
Figure 3:
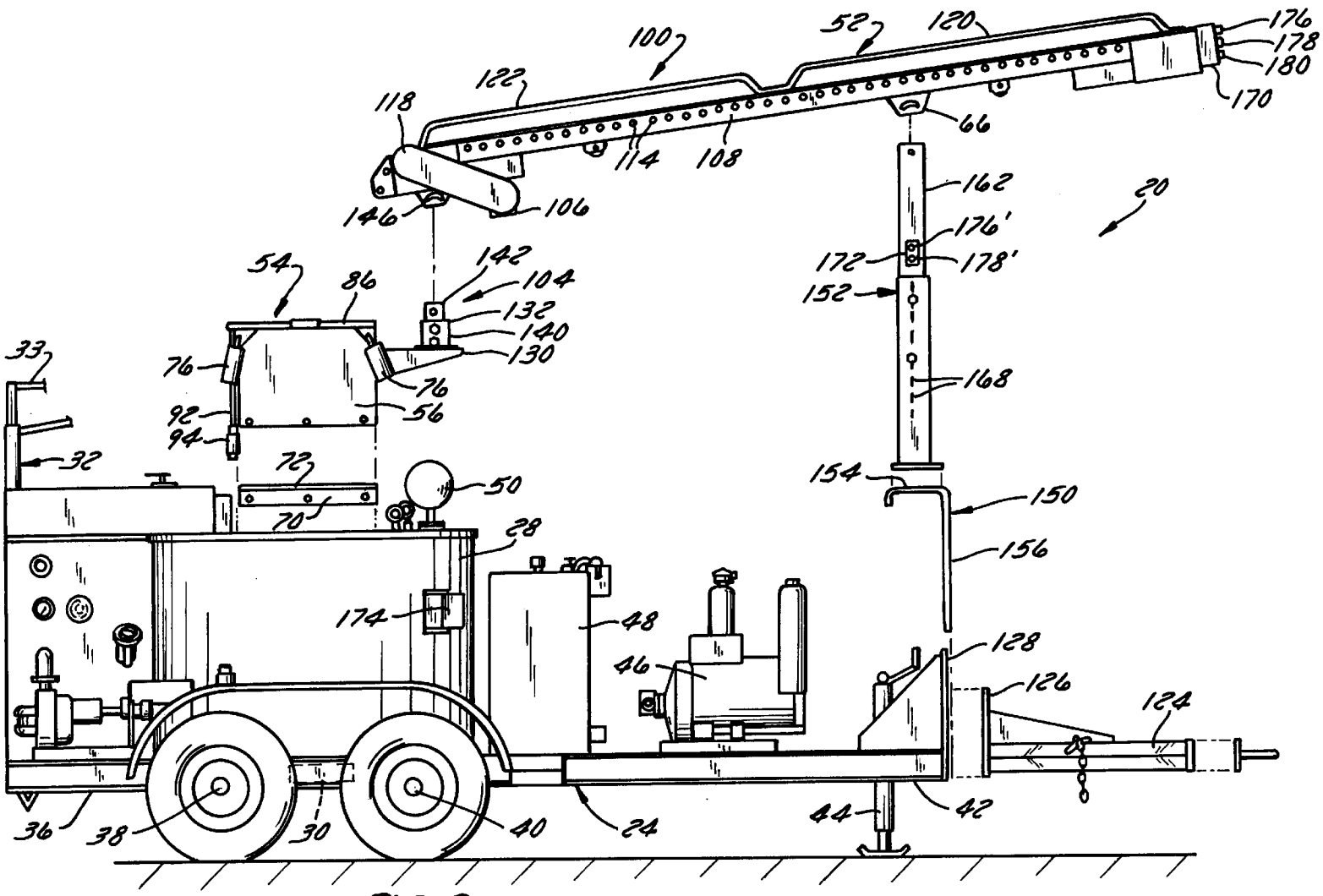
FIG. 3 is a partially-exploded side elevation view of the sealant melter of FIGS. 1 and 2, illustrating the components of the sealant melter that are installable on it in a retrofit operation in exploded form.
Figure 4:
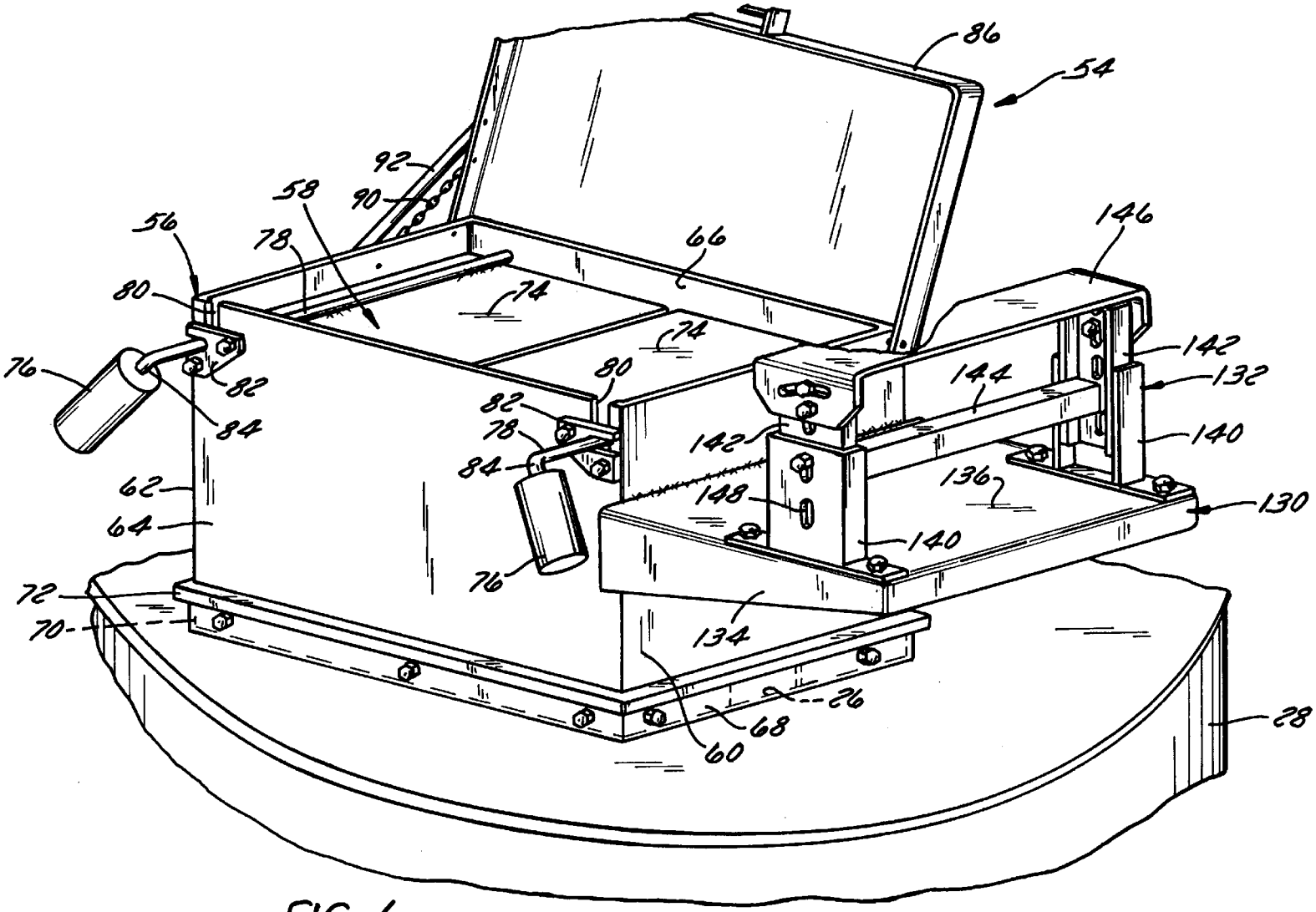
FIG. 4 is a perspective view of a portion of the sealant melter of FIGS. 1–3 including a splash box of the sealant block feed assembly and an associated rear conveyor support assembly.
Figure 5:
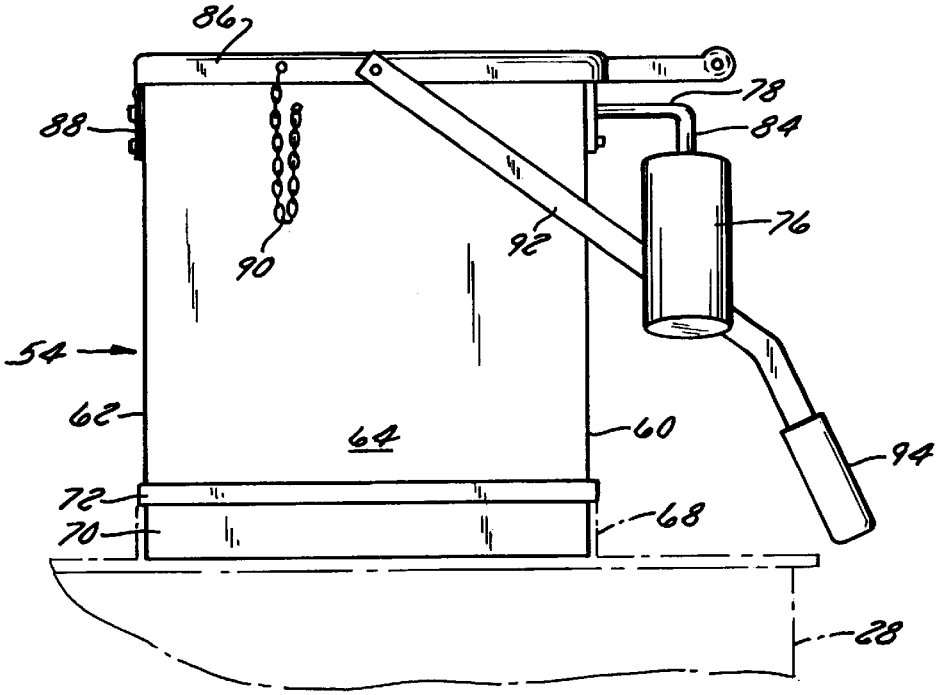
FIG. 5 is a side elevation view of the splash box of FIG. 4, illustrating the lid of the splash box in a closed position.
Figure 6:
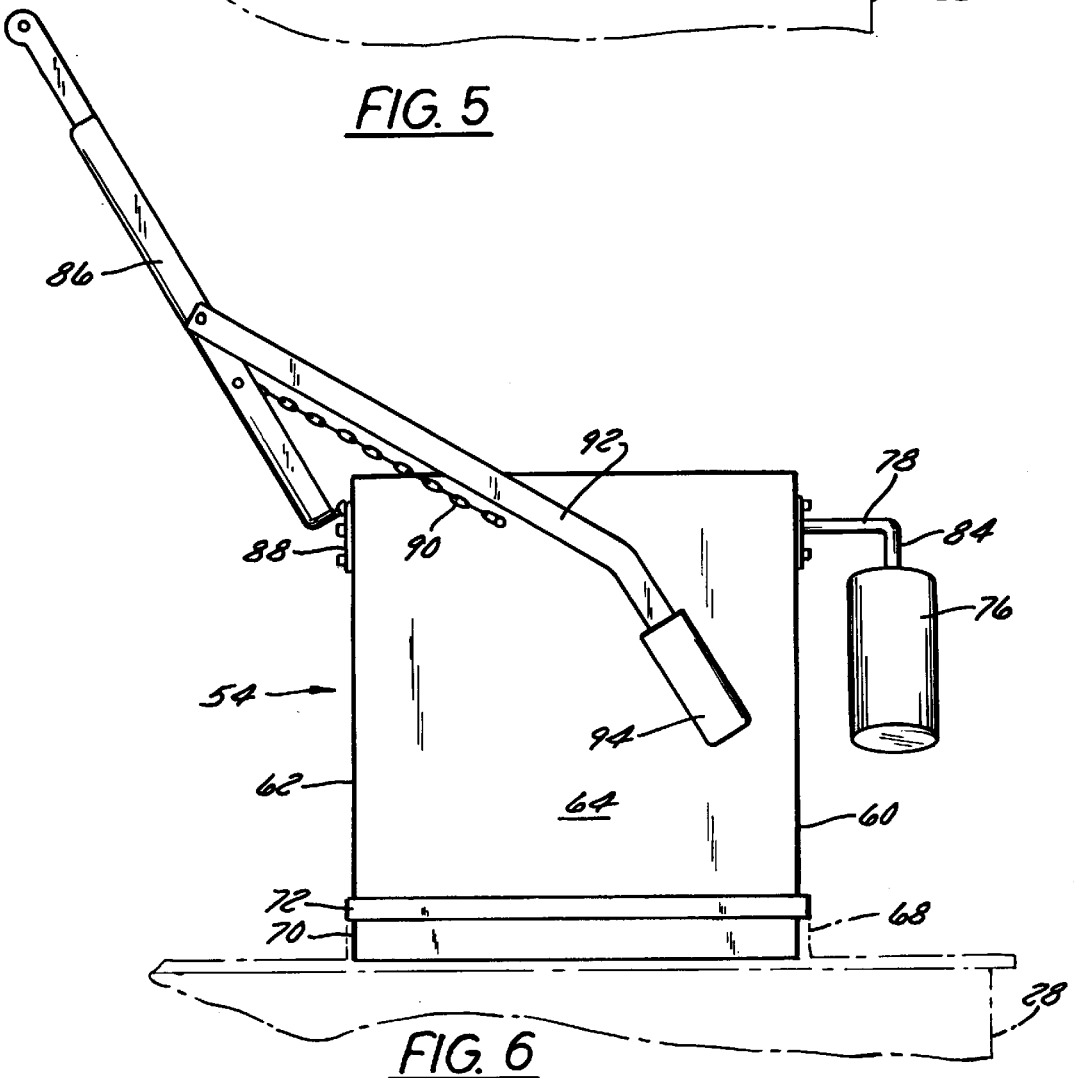
FIG. 6 corresponds to FIG. 5 and illustrates the lid of the splash box in an open position.

Referring now to the drawings and to FIGS. 1–3 in particular, a sealant melter 20 is illustrated that incorporates a sealant block feed assembly 22 constructed in accordance with a preferred embodiment of the invention. The sealant melter 20 additionally includes a trailer 24 on which is mounted the sealant block feed assembly 22, a sealant tank 28, a heater assembly 30, and an applicator assembly 32. The trailer 24 is towed by a towing/storage vehicle 34 that may comprise a dump truck as illustrated, a pick-up truck, a flatbed truck, etc.

The trailer 24 is conventional (with the possible exception of having its hitch supplemented by or replaced with an extended hitch as detailed below). The trailer 24 includes a frame or chassis 36 which is mounted on tandem axles 38 and 40 at its rear end and which terminates in a hitch portion 42 at its front end. The hitch portion 42 is supported on a jack 44 in the conventional manner when not being towed by the towing/storage vehicle 34.

The sealant tank 28, heater assembly 30, and applicator assembly 32 are conventional. The sealant tank 28 is mounted on the trailer frame 36 approximately midway between the tandem axles 38 and 40 so as to have its weight distributed substantially evenly between the axles 38 and 40. The sealant tank 28 has an upper sealant block inlet 26 and a lower liquid sealant outlet (not shown). The heater assembly 30 includes a conventional diesel fuel-fired burner which is located under the sealant tank 28 and which heats the sealant tank 28 from the bottom. The applicator assembly 32 includes a holder 33 mounted on the rear of the trailer 24 for storing a wand 31 or any other suitable sealant applicator(s). Hydraulic and electrical power for all system components is generated by a conventional diesel-powered engine 46. Fuel for the burner and oil for the hydraulic systems is stored in a tank arrangement 48. An overflow tank 50 also is provided for storing heated oil overflowing from the tank arrangement 48 due to thermal expansion.

In use, the heater assembly 30 heats sealant in the sealant tank 28 to a temperature of about 550° F., thereby melting the solid sealant blocks B and forming a hot viscous liquid suitable for application to joints or cracks. This liquid then is dispensed in the usual manner using the applicator(s) of the assembly 32.

The sealant block feed assembly 22 is designed to permit the controlled supply of sealant blocks B from the towing/storage vehicle 34 to the sealant tank 28 and to prevent liquid sealant in the sealant tank 28 from splashing out of it upon sealant block ingress. The sealant block feed assembly 22 is also designed to be incorporated into a variety of sealant melter configurations and/or to be retrofittable onto a variety of previously-assembled sealant melter machines. A preferred sealant block feed assembly 22, a method for its incorporation into a standard sealant melter 20, and a method for its operation now will be detailed.

3. Construction of Sealant Block Feed Assembly

Referring to FIGS. 1 through 3, the sealant block feed assembly 22 includes 1) a sealant block conveyor assembly 52 adapted to convey sealant blocks B from the towing/storage vehicle 34 to the sealant tank 28, and 2) a splash box 54 mounted on the sealant tank 28 so as to receive sealant blocks B from the sealant block conveyor assembly 52 and to direct them into the sealant tank 28 while sealant with hot liquid sealant within the sealant tank 28 from splashing out of it. Each of these assemblies 52 and 54 now will be detailed.

Referring now to FIGS. 1–7, the splash box 54 includes 1) a receptacle 56 for receiving sealant blocks B and for guiding the received sealant blocks into the sealant tank inlet 26, 2) an internal splash guard 58 for preventing splashing, and 3) a lid 86. The splash box 54 also supports a rear conveyor support assembly 104 so as to facilitate retrofitting.

The receptacle 56 is a rectangular structure having open top and bottom surfaces defining a splash box inlet and a splash box outlet, respectively. The receptacle 56 is formed from a plurality of interconnected metal plates defining a receptacle front wall 60, a receptacle rear wall 62, and a pair of receptacle sidewalls 64 and 66. A downwardly-extending skirt 70 and outwardly-extending support ring 72 are mounted on the bottom end of the receptacle 56 and are used to mount the receptacle 56 on the tank 28. Specifically, the receptacle 56 is mounted over the existing inlet opening 26 of the sealant tank 58 and attached to an existing lip 68 of the sealant tank 28 designed to mate with a stock hatch. The stock hatch will have to be removed prior to this procedure if the sealant block feed assembly is added in a retrofit operation. The bottom skirt 70 of the receptacle 56 is positioned inside the lip 68 so that the peripheral support ring 72 rests on top of the lip 68. The receptacle 56 can then be attached to the lip 68. This attachment may include drilling holes in the lip 68 at locations matching the locations of pre-drilled holes in the skirt 70 and then bolting the skirt 70 to the lip 68. Alternatively, the receptacle 56 could be fixed in location by welding the horizontal support ring 72 to the upper surface of the lip 68.

The splash guard 58 is designed to permit sealant blocks B to enter the splash box 54 while preventing liquid sealant from splashing out of the splash box 54 when sealant blocks B drop into the sealant tank 28. The splash guard 58 preferably comprises a structure that automatically opens upon entry of a sealant block and that automatically closes after sealant block passage to prevent sealant splashing. The preferred and illustrated splash guard includes a pair of independently pivotable flaps 74 each of which is biased into its closed position by a return mechanism 76. The flaps 74 face one another so as to extend substantially horizontally completely or substantially completely across the receptacle 56 when in their closed position. The vertical spacing between the flaps 74 and the bottom of the receptacle 56 is set such that a sealant block B falling through the splash box 54 clears the flaps 74 and permits them to close before it contacts the liquid sealant stored in the sealant tank 28, thereby providing an opportunity for the flaps 74 to swing to their closed position before the block B contacts the liquid sealant.

Each flap 74 is welded at its outer end to a pivot rod 78 that in turn extends horizontally across the receptacle 56 and is rotatably mounted in apertures formed in the opposed sidewalls 64 and 66 of the receptacle 56. Preferably, one aperture takes the form of a slot 80 so that the associated pivot rod 78 can simply be inserted in the opposed aperture, dropped into place within the slot 80, and then held in place by a keeper plate 82. The keeper plate 82 in turn is bolted or otherwise attached to the side wall 64 of the receptacle 56. One end 84 of each rod 78 extends substantially beyond the sidewall 64 and is bent downwardly and outwardly at an angle of approximately 45° from the vertical. The return mechanisms 76 each comprise a pair of metal counterweights threaded onto or otherwise fixed to the bent end 84 of the associated rod 78 so as to bias the rod 78 and hence the flap 74 to the position illustrated in FIG. 4.

The lid 86 is closed when not in use and opened manually prior to and during melter operation. The lid 86 is pivotably attached to the sidewall 66 of the splash box 54 by a hinge 88. A safety chain 90 prevents the lid 86 from swinging open more then its maximum intended angle of about 120° from its closed horizontal position. The lid 86 is opened and closed manually using a handle 92 that extends downwardly and forwardly from one side of the lid 86. The handle 92 preferably is formed from wood or another thermally non-conductive material and has a rubber grip 94 on its end so that the operator can open and close the lid when the sealant tank 54 is full of hot liquid sealant without burning his or her hand. The grip 94 of the handle 92 is positioned adjacent the bottom rear portion of the splash box 54 so that it is easily accessible by a curbside-stationed operator.

The conveyor assembly 52 is designed for the controlled loading of sealant blocks B from the towing/storage vehicle 34 and for the controlled delivery of the loaded sealant blocks to the splash box 54. The conveyor assembly 52 includes a sealant block conveyor 100, front and rear conveyor support assemblies 102 and 104, and a conveyor control assembly.

The sealant block conveyor 100 could comprise an unpowered conveyor such as a non-driven roller conveyor or a chute. It is preferred, however, that the sealant block conveyor 100 be powered under operator control so as to permit the controlled feed of sealant blocks B to the splash box 54 either from the vehicle 34 or from curbside. Referring now to FIGS. 1–3 and 7, the sealant block conveyor 100 preferably comprises a belt conveyor having an inlet end positioned adjacent the vehicle 34 and an outlet end positioned adjacent the upper inlet of the splash box 54. The conveyor 100 includes a pair of laterally opposed sideframes 108 supporting an idler pulley 110 at the conveyor's inlet end, a drive pulley 112 at its discharge end, and a plurality of idler rollers 114 spaced evenly between the drive pulley 112 and the driven pulley 110, and a conveyor belt 116 riding over the pulleys 110 and 112 and the rollers 114. The drive pulley 112 is driven by a chain (located under a guard 118) which in turn is driven by a hydraulic motor 106. The motor 106 is mounted on the conveyor 100 and receives hydraulic fluid from the engine 46.

The typical sealant block weights about 30 lbs, and the illustrated sealant block conveyor 100 is long enough to support as many as eleven to thirteen standard-sized sealant blocks B. Temperatures above the splash box inlet may reach 300° F. to 500° F. during operation of the sealant melter 20. The rollers 114 and pulleys 110 and 112 are configured to be capable of conveying sealant blocks B positioned back-to-back along the length of the sealant block conveyor 100 and to withstand the heat of the splash box 54. The conveyor belt 116 should be formed from a material that is capable of supporting about 800 lbs and of withstanding heat transferred from the splash box 54. A conveyor belt formed from white friction surface 90-Butyl 3-ply belting material is preferred.

First and second laterally opposed, longitudinally extending sets of guides are preferably bolted onto the upper surfaces of the opposed conveyor side frames 108 so as to inhibit the sealant blocks B from falling over the side of the sealant block conveyor 100 if the conveyor 100 is jostled, e.g., during trailer transport. Referring especially to FIGS. 1 and 3, each set of guides includes a front guide rod 120 and a rear guide rod 122, each of which is formed from a bent piece of rolled steel tube. The ends of each tube are bent into a generally L-shaped configuration to produce a mounting portion for bolting the tube into the associated conveyor side frame 108. The tubes of the guide rods 120 and 122 are bent such that the majority of each rod 120 or 122 is spaced further above the conveyance surface of the sealant block conveyor 100 than the center of gravity of the sealant blocks B.

The inlet end of the sealant block conveyor 100 is configured to extend over the back of the towing/storage vehicle 34 as illustrated in FIG. 1. The length of the conveyor belt 116 preferably is longitudinally adjustable in the conventional manner by operation of a takeup screw (not shown). Accurate vertical positioning is assured through adjusting the front conveyor support assembly 102 as detailed below. Depending upon the design of the stock trailer 24, it may be necessary to replace the stock hitch (not shown) with an extended hitch 124 in order to accommodate the relatively long sealant block conveyor 100 and the associated front conveyor support assembly 102. The manner in which this replacement may be effected is best seen in FIG. 3, which illustrates an extended hitch 124 having a vertical rear plate 126 that can be bolted to the existing hitch plate 128 of the trailer frame 38 to which the stock hitch would have similarly been bolted.

Figure 7:
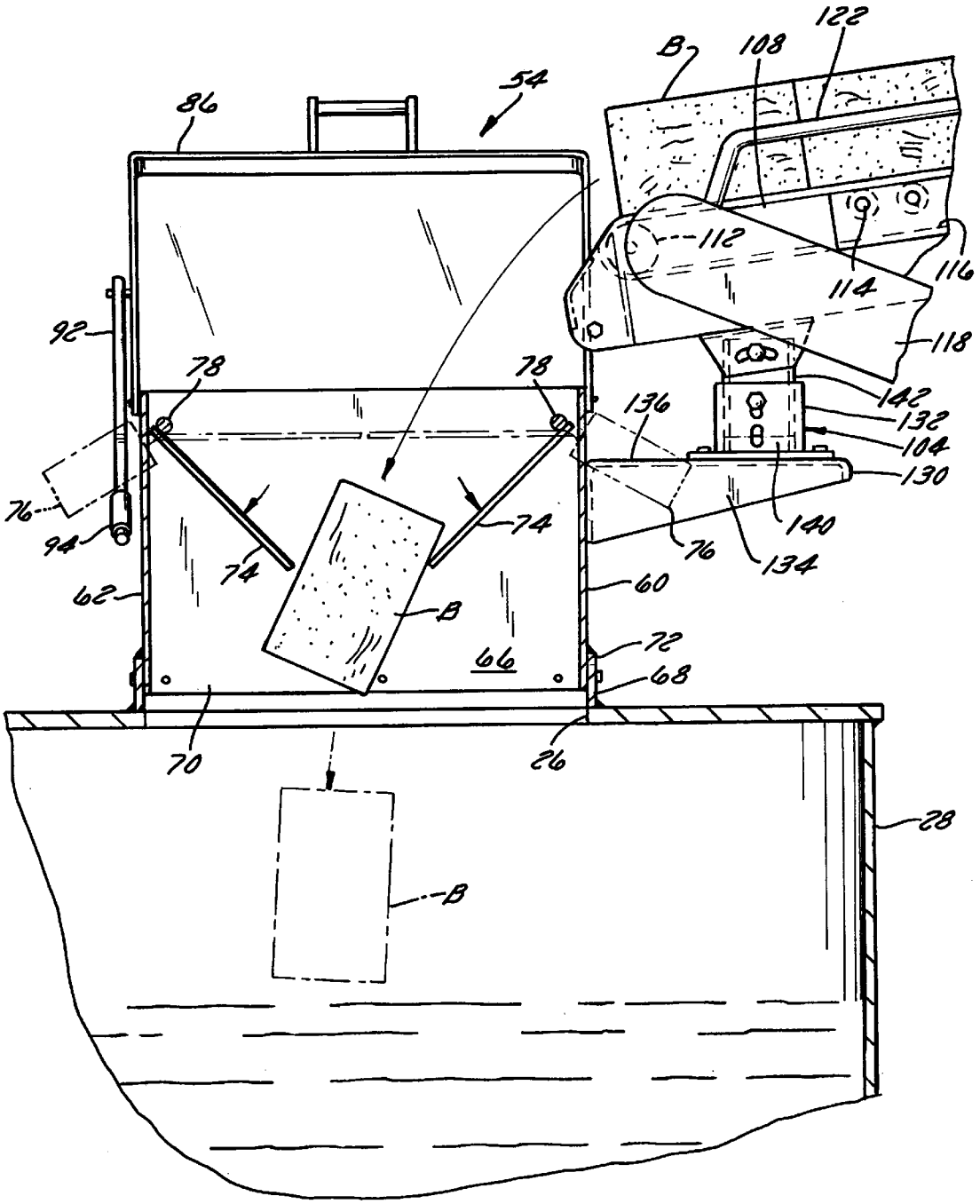
FIG. 7 is a partially cut-away side elevation view illustrating the feed of a sealant block into the splash box of FIGS. 4–6.
Figure 8:
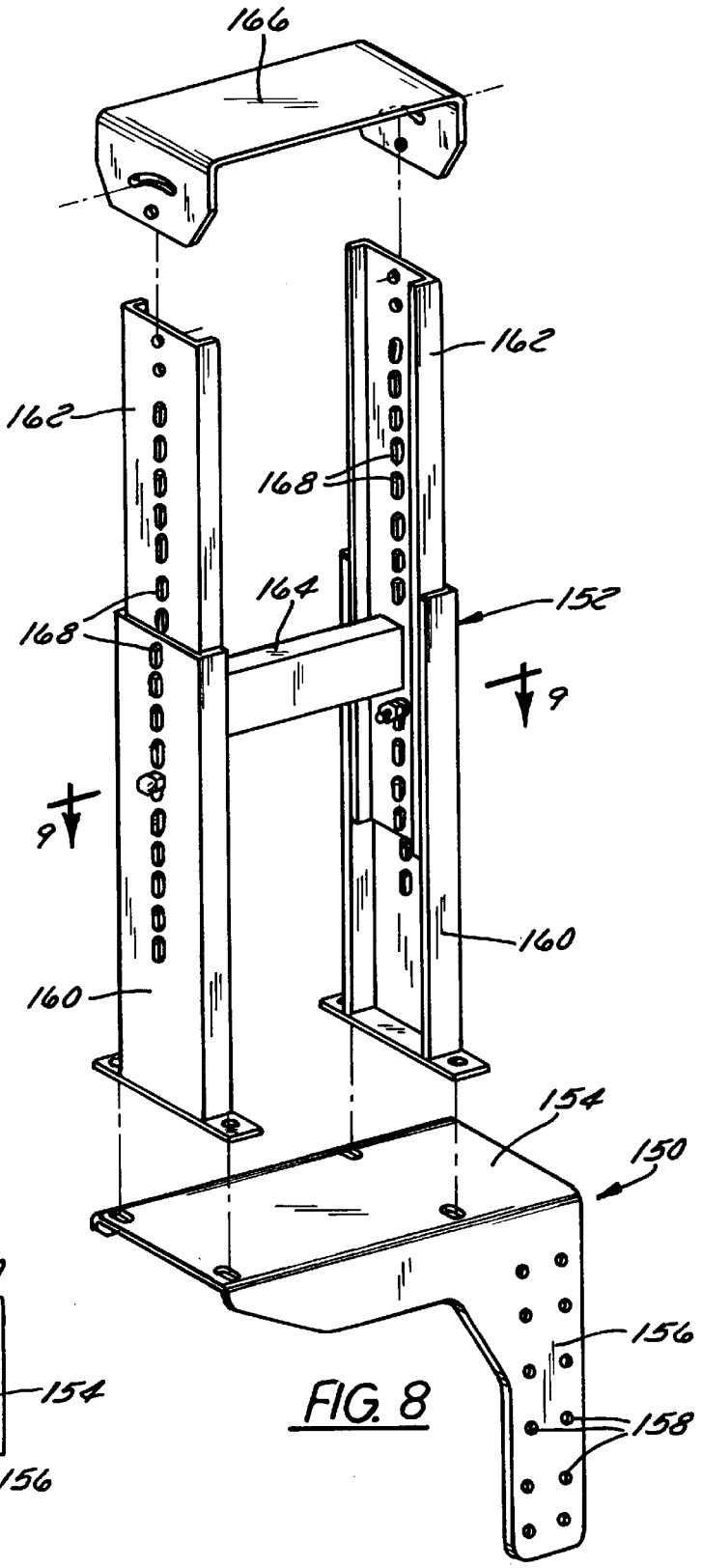
FIG. 8 is a partially-exploded perspective view of the front conveyor support assembly of the sealant block feed assembly.
Figure 9:
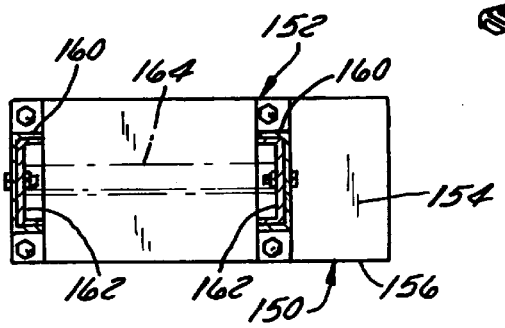
FIG. 9 is a sectional view taken along the lines 9—9in FIG. 8.
Figure 10:
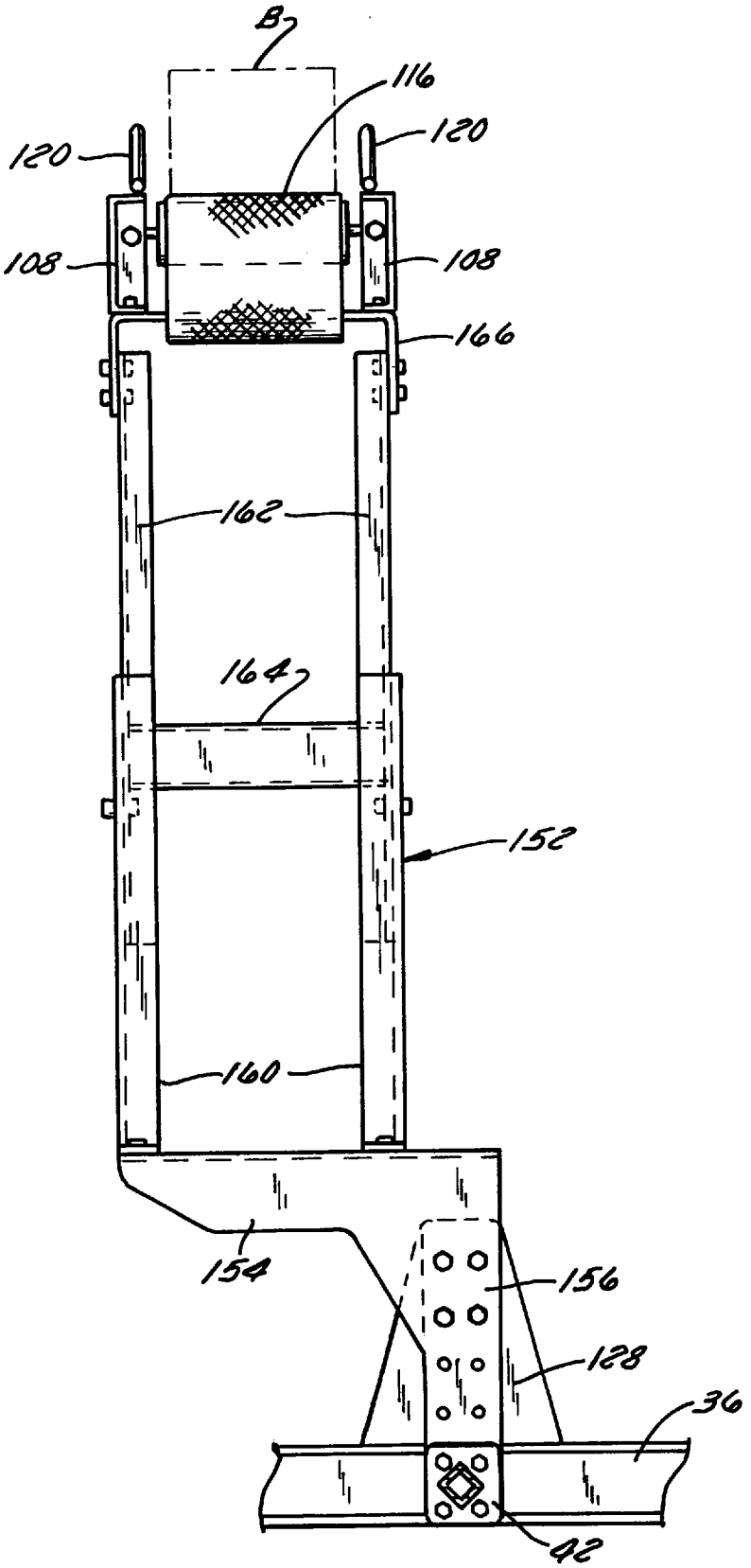
FIG. 10 is a front elevation view of a portion of the front conveyor support assembly.

The front and rear conveyor support assemblies 102 and 104 are designed to permit retrofit installation of the sealant block conveyor assembly 52 on the trailer 24 and to permit vertical adjustment of one and preferably both ends of the conveyor 100 relative to the trailer 34. Referring especially to FIGS. 1, 3, and 7, the rear conveyor support assembly 104 includes 1) a leg brace 130 mounted on the splash box 54 and 2) a vertically adjustable conveyor support 132 mounted on the leg brace 120. The leg brace 130 includes a bent steel plate having horizontal and vertical legs reinforced by gussets 134 extending horizontally under an upper surface 136 of the horizontal leg. The inner end of the leg brace 130 is welded or otherwise affixed to front wall 60 of the splash box 54, preferably prior to final installation of the sealant block feed assembly 22 on the sealant melter 20. The conveyor support 132 is bolted to the upper surface 136 of the leg brace 130. Conveyor support 132 includes 1) a pair of laterally spaced, vertically extending outer C-members 140 bolted to the upper surface 136 of leg brace 130 and 2) a corresponding pair of laterally spaced, vertically extending inner C-members 142 slidably and telescopically received in the outer C-members 140 and connected to one another by a cross brace 144. The discharge end of the sealant block conveyor 100 is supported on the inner members 142 by a support plate 146 having its opposed ends pivotably mounted on the upper ends of the inner members 142. The height of the inner members 142 relative to the outer members 140 can be adjusted simply by removing bolts from aligned slots 148 formed in the inner and outer members 142 and 140, raising or lowering the inner members 142, and bolting the inner members to the outer members through a different set of matching slots 148.

Referring now especially to FIGS. 1, 3, and 8–10, the front conveyor support assembly 102 preferably includes 1) a pintle plate 150 and 2) a telescoping conveyor support 152 that is mounted on the pintle plate 150. The pintle plate 150 is bent at its upper end to present a horizontal support leg 154 and a vertical attachment leg 156. The attachment leg 156 is configured for attachment to the existing trailer hitch plate 128. The attachment leg 156 preferably has a plurality of sets of vertically-spaced holes 158 formed therein to accommodate different trailer designs—thereby facilitating a retrofit installation.

The telescoping conveyor support 152 includes 1) a pair of laterally-spaced, vertically-extending outer C-members 160 bolted to the upper surface of the horizontal support leg 154 and 2) a corresponding pair of laterally-spaced, vertically-extending inner C-members 162 slidably and telescopically received within the outer members 160 and connected to one another by a cross brace 164. A conveyor support plate 166 is pivotably mounted at its opposed ends to the upper ends of the inner C-members 162 and in turn supports the inlet end of the sealant block conveyor 100. The vertical position of the support plate 166 and hence of the inlet end of the sealant block conveyor 100 can be adjusted up to one foot or more simply by removing bolts from aligned slots 168 in the inner and outer 162 and 160, moving the inner members 162 vertically relative to the outer members 160, and reinserting the bolts in different slots 168.

The conveyor control assembly is designed to permit operator control of the sealant block conveyor 100 either from the vehicle 34 or from curbside. To this end, the conveyor control assembly includes two separate and independently controlled operator's boxes 170 and 172. The operator's box 170 is mounted on the inlet end of the sealant block conveyor 100 to permit control from inside the towing/storage vehicle 34. The operator's box 172 is mounted on the front conveyor support assembly 102 to permit curbside control. Both operator's boxes 102 and 104 are electronically connected to a common control box 174 which in turn controls operation of valves (not shown) controlling the flow of pressurized hydraulic fluid to and from the motor 106. In the illustrated and preferred embodiment, both control boxes 170 and 172 include an emergency ON button 176, 176' and an emergency STOP button 178, 178'. The operator's box 170 on the inlet end of the conveyor preferably additionally includes a FORWARD/REVERSE switch 180 to permit controlled conveyor reversal for reasons detailed below. The buttons 176, 176', 178, and 178' are configured such that conveyance occurs only for so long as one of the ON buttons 176 or 176' is depressed by the operator and ceases immediately upon button release. The emergency STOP buttons 178 and 178' operate to override the ON buttons 176 or 176' and to arrest conveyor movement should one operator wish to override the operation of another or should one of the ON buttons 176 or 176' short circuit or become stuck in its activated condition. The electronics associated with controlling operation of the valves based upon operation of the buttons 176, 176', 178, 178' and the switch 180 are easily designable by those skilled in the art from the foregoing description of the intended function, and hence will not be detailed.

4. Operation of Sealant Melter

Referring now to FIGS. 1 through 3, the sealant melter 20 is readied for operation by towing it to a worksite using a towing/storage vehicle 34 that preferably also hauls sealant blocks B. If necessary, the vertical position of the inlet end of the sealant block conveyor 100 can be adjusted prior to operation to conform to the height of the towing/storage vehicle 34 by suitable adjustment of the front conveyor support assembly 102. The longitudinal length of the conveyor belt 116 can also be adjusted by adjusting the takeup screw (not shown) in a conventional manner. The engine 46 then is started, and the burner of the heater assembly 30 is ignited to heat the sealant tank 28. The operator then opens the lid 86 of the splash box 54 using the handle 92 to prepare the splash box 54 for receiving sealant blocks B.

An operator stationed on the vehicle 34 then loads sealant blocks B onto the inlet end of the sealant block conveyor 100 one at a time by alternately loading sealant blocks B onto the sealant block conveyor 100 and then pressing the momentary ON button 176 on the inlet end of the conveyor 100 to convey the previously-loaded blocks downline a sufficient distance to provide enough space at the end of the conveyor 100 to receive an additional sealant block. This process may be repeated until the entire conveyor 100 supports blocks B in an end-to-end fashion as illustrated in FIG. 1.

The operator then controls the sealant block conveyor 100 to feed sealant blocks B into the splash box 54 one at a time using either the operator's box 170 on the inlet end of the conveyor 100 or the curbside operator's box 172. The conveyor support assembly 104 at the discharge end of the conveyor 100 acts as a bridge or guide during this operation that guides the discharged sealant blocks B into the splash box 54 without any delays. This feeding operation typically will be performed only intermittently because each sealant block B typically requires 5–8 minutes of heating to melt and because the operator need not continuously monitor the status of the sealant block feed assembly. The curbside operator's box 172 will be used most often for sealant block feeding control because the operator can control sealant block feed while standing on the ground and monitoring operation of the sealant melter 20 and/or assisting with other sealant application operations. The need for two cooperating operators to feed sealant blocks B to the sealant tank 28 therefore is eliminated.

When a sealant block B is discharged into the splash box 54 through the splash box upper inlet, it engages the splash guards or flaps 74 and pushes them open against the biasing effect of the counterweights 76 as seen in FIG. 7. The flaps 74 remain open until the falling sealant block B moves past the bottommost end of the flaps 74, at which point they will swing back under the biasing effect of the counterweights 76. As discussed above, the vertical spacing between the flaps 74 and the bottom end of the splash box 54 is dimensioned such that the flaps 74 will close before the falling sealant block B impinges liquid sealant stored within the sealant tank 28, thereby assuredly preventing liquid sealant in the sealant tank 28 from splashing out of it.

If at any time during these procedures the operator discerns a problem with the sealant melter 20, or if the momentary ON button 176 becomes stuck or malfunctions, conveyor movement can be arrested by depressing either of the emergency STOP buttons 178 or 178'.

If the operator wishes to return sealant blocks B on the sealant block conveyor 100 to the vehicle rather than discharging them into the splash box 54 (for example at the end of the day or when the trailer 24 is to be moved to another site), he or she simply switches the FORWARD/REVERSE switch 180 from its normal FORWARD position to its alternative REVERSE position and depresses one of the momentary ON buttons 176 or 176' for a sufficient period of time to return all of the sealant blocks B to the towing/storage vehicle 34.

Many changes and modifications could be made to the invention without departing from the spirit thereof. For instance, as discussed above, the illustrated power conveyor could conceivably be replaced by an unpowered gravity feed conveyor. In addition, the mounting of the pintle plate on the frame likely will vary from application to application depending upon trailer frame design. The scope of other changes will become apparent from the appended claims.

I claim:

1. A sealant melter, comprising:

(A) mobile frame;

(B) heated sealant tank mounted on said frame, said sealant tank having a liquid sealant discharge opening and an upper sealant block inlet opening;

(C) a splash box disposed above said inlet opening of said sealant tank, said splash box having an upper splash box inlet and having a lower splash box outlet disposed above said inlet opening of said sealant tank; and (D) a sealant block conveyor which conveys sealant blocks from a source to said splash box inlet, said sealant block conveyor having 1) a discharge end positioned adjacent said splash box inlet and 2) an inlet end; and wherein said inlet end of said sealant block conveyor is vertically adjustable relative to said frame.

2. A sealant melter as defined in claim 1 further comprising a telescoping support which effects vertical adjustment of said inlet end of said sealant block conveyor relative to said frame, said telescoping support comprising 1) a pair of laterally spaced, generally vertically-extending outer members, 2) a pair of laterally spaced, generally vertically-extending inner members each of which slidably mates with one of said outer members, and 3) a plurality of connectors detachably connecting said inner members to said outer members.

3. A sealant melter as defined in claim 1, further comprising a support plate which is removably attached to said frame and on which said inlet end of said sealant block conveyor is mounted.

4. A sealant melter as defined in claim 1, wherein said sealant block conveyor is a powered conveyor.

5. A sealant melter as defined in claim 4, further comprising a conveyor control assembly which is mounted on said inlet end of said sealant block conveyor and which includes a manually-operated ON button which, when actuated, causes motive power to be supplied to said sealant block conveyor.

6. A sealant melter as defined in claim 5, wherein said conveyor control assembly further comprises a manually-operated emergency stop button which is mounted on said inlet end of said sealant block conveyor and which, when actuated, overrides said ON button to cut off the supply of motive power to said sealant block conveyor.

7. A sealant melter as defined in claim 5, wherein said ON button is a first ON button, and wherein said conveyor control assembly further comprises a second manually-operated ON button which is located remote from said first ON button and which, when actuated, causes motive power to be supplied to said sealant block conveyor.

8. A sealant melter as defined in claim 1, wherein said discharge end of said sealant block conveyor is mounted on said splash box.

9. A sealant melter comprising:

(A) a mobile frame:

(B) a heated sealant tank mounted on said frame, said sealant tank having a liquid sealant discharge opening and an upper sealant block inlet opening;

(C) a splash box disposed above said inlet opening of said sealant tank, said splash box having an upper splash box inlet and having a lower splash box outlet disposed above said inlet opening of said sealant tank;

(D) a sealant block conveyor which conveys sealant blocks from a source to said splash box inlet, said sealant block conveyor having 1) a discharge end positioned adjacent said splash box inlet and 2) an inlet end; and wherein said frame is a trailer frame having a hitch disposed forwardly of said sealant tank, and wherein said sealant block conveyor extends longitudinally forwardly from said sealant tank and over said hitch, and further comprising an extended hitch which is removably attached to a forward end of said hitch and which extends longitudinally forwardly from said hitch.

10. A sealant melter for melting a block of sealant, the sealant melter comprising:

(A) a mobile frame;

(B) a heated sealant tank mounted on said frame, said sealant tank having a liquid sealant discharge opening and an upper sealant block inlet opening;

(C) a splash box disposed above said inlet opening of said sealant tank, said splash box having an upper splash box inlet and having a lower splash box outlet disposed above said inlet opening of said sealant tank; and wherein said splash box further comprises a splash guard which is located above said splash box outlet and which 1) automatically opens in response to sealant block ingress to permit passage of a sealant block therethrough and 2) automatically closes upon sealant block egress to prevent liquid sealant from splashing out of said splash box.

11. A sealant melter comprising:

(A) a mobile frame;

(B) a heated sealant tank mounted on said frame, said sealant tank having a liquid sealant discharge opening and an upper sealant block inlet opening;

(C) a splash box disposed above said inlet opening of said sealant tank, said splash box having an upper splash box inlet and having a lower splash box outlet disposed above said inlet opening of said sealant tank;

wherein said splash box further comprises a splash guard which is located above said splash box outlet and which 1) automatically opens upon sealant block ingress to permit passage of a sealant block therethrough and 2) automatically closes upon sealant block egress to prevent liquid sealant from splashing out of said splash box; and wherein said splash guard comprises a pair of flaps which are mounted on said splash box so as to be pivotable about a horizontal axis 1) from a closed position in which they extend generally horizontally towards one another and separate said splash box inlet from said splash box outlet 2) to an open position in which they extend at an angle with respect to the horizontal and permit passage of said sealant blocks therepast, and a return mechanism which biases said flaps towards said closed position.

12. A sealant melter as defined in claim 11, wherein said return mechanism comprises a pair of counterweights, each of which is coupled to a respective one of said flaps.

13. A sealant melter comprising:

(A) a mobile trailer including a frame;

(B) a heated sealant tank mounted on said frame, said sealant tank including a liquid sealant discharge opening and an upper sealant block inlet opening;

(C) a splash box mounted on said sealant tank above said inlet opening of said sealant tank, said splash box including (1) an upper splash box inlet, (2) a lower splash box outlet disposed above said inlet opening of said sealant tank, and (3) a splash guard which is located above said splash box inlet and which 1) automatically opens in response to sealant block ingress to permit passage of a sealant block therethrough and 2) automatically closes upon sealant box egress to prevent liquid sealant from splashing out of said splash box; and (D) a sealant block conveyor which conveys sealant blocks from a source to said inlet opening of said splash box, said sealant block conveyor having 1) a discharge end positioned adjacent said splash box inlet and 2) an inlet end.

14. A sealant melter comprising:

(A) a mobile trailer including a frame;

(B) a heated sealant tank mounted on said frame, said sealant tank including a liquid sealant discharge opening and an upper sealant block inlet opening;

(C) a splash box mounted on said sealant tank above said inlet opening of said sealant tank, said splash box including (1) an upper splash box inlet, (2) a lower splash box outlet disposed above said inlet opening of said sealant tank, (3) a splash guard which is located above said splash box inlet and which 1) automatically opens upon sealant block ingress to permit passage of a sealant block therethrough and 2) automatically closes upon sealant box egress to prevent liquid sealant from splashing out of said splash box, and (D) a sealant block conveyor which conveys sealant blocks from a source to said inlet opening of said splash box, said sealant block conveyor having 1) a discharge end positioned adjacent said splash box inlet and 2) an inlet end; and (E) a telescoping support which effects vertical adjustment of said inlet end of said sealant block conveyor relative to said frame, said telescoping support comprising 1) a pair of laterally spaced, generally vertically-extending outer members, 2) a pair of laterally spaced, generally vertically-extending inner members each of which slidably mates with one of said outer members, and 3) a plurality of connectors detachably connecting said inner members to said outer members.

15. A sealant melter comprising:

(A) a mobile trailer including a frame;

(B) a heated sealant tank mounted on said frame, said sealant tank including a liquid sealant discharge opening and an upper sealant block inlet opening;

(C) a splash box mounted on said sealant tank above said inlet opening of said sealant tank, said splash box including (1) an upper splash box inlet, (2) a lower splash box outlet disposed above said inlet opening of said sealant tank, (3) a splash guard which is located above said splash box inlet and which 1) automatically opens upon sealant block ingress to permit passage of a sealant block therethrough and 2) automatically closes upon sealant box egress to prevent liquid sealant from splashing out of said splash box;

(D) a sealant block conveyor which conveys sealant blocks from a source to said inlet opening of said splash box, said sealant block conveyor having 1) a discharge end positioned adjacent said splash box inlet and 2) an inlet end; and wherein said splash guard comprises a pair of flaps which are mounted on said splash box so as to be pivotable about a horizontal axis 1) from a closed position in which they extend generally horizontally towards one another and separate said splash box inlet from said splash box outlet 2) to an open position in which they extend at an angle with respect to the horizontal and permit passage of said sealant blocks therepast, and a pair of counterweights, each of which is coupled to a respective one of said flaps, wherein said counterweights return said flaps to said closed position after a sealant block passes through said splash box.

16. A sealant melter comprising:

(A) a trailer including a pair of wheels, a frame supported on said wheels, and a hitch extending longitudinally forwardly from said frame;

(B) a heated sealant tank mounted on said frame, said sealant tank including a lower liquid sealant discharge opening and an upper sealant block inlet opening;

(C) a splash box mounted on said sealant tank above said inlet opening of said sealant tank, said splash box including (1) an upper splash box inlet, (2) a lower splash box outlet disposed above said inlet opening of said sealant tank, (3) a pair of flaps which are mounted on said splash box so as to be pivotable about a horizontal axis 1) from a closed position in which they extend generally horizontally towards one another and separate said splash box inlet from said splash box outlet 2) to an open position in which they extend at an angle with respect to the horizontal and permit passage of said sealant blocks therepast, (4) a pair of counterweights, each of which is coupled to a respective one of said flaps, wherein said counterweights automatically return said flaps to said closed position after a sealant block passes through said splash box, (5) a lid which is mounted on said splash box at a location above said flaps and which is pivotable from a closed position covering said splash box inlet to an open position exposing said splash box inlet, and (6) a manually-operated handle coupled to said lid, said handle extending downwardly from said lid to facilitate access by an operator standing on the ground; and (D) a conveyor assembly including (1) a first conveyor support attached to said splash box, (2) a second conveyor support mounted on said trailer frame at a location longitudinally in front of said sealant tank, said second conveyor support including (a) a pair of laterally spaced, generally vertically-extending outer members, (b) a pair of laterally spaced, generally vertically-extending inner members each of which slidably mates with one of said outer members, and (c) a plurality of connectors detachably connecting said inner members to said outer members, (3) a powered belt conveyor which conveys sealant blocks from a source to said inlet opening of said splash box, said sealant block conveyor having 1) a discharge end mounted on said first support and positioned adjacent said splash box inlet and 2) an inlet end mounted on said second support, and (4) a conveyor control assembly which is mounted on said discharge end of said sealant block conveyor and which includes (a) a first manually-operated ON button which is mounted on said inlet end of said sealant block conveyor and which, when actuated, causes motive power to be supplied to said sealant block conveyor, (b) a second manually-operated ON button which is located remote from said first ON button and which, when actuated, causes motive power to be supplied to said sealant block conveyor, (c) a first manually-operated emergency stop button which is mounted on said inlet end of said sealant block conveyor and which, when actuated, overrides said first and second ON buttons to cut off the supply of motive power to said sealant block conveyor, and (d) a second manually-operated emergency stop button which is remote from said inlet end of said sealant block conveyor and which, when actuated, overrides said first and second ON buttons to cut off the supply of motive power to said sealant block conveyor.

17. A splash box configured for mounting on a heated sealant tank of a sealant melter and for directing sealant blocks into an upper inlet of the sealant tank, said splash box comprising:

(A) an enclosure comprising a plurality of sidewalls, a top in which is formed a sealant block inlet dimensioned and configured to receive a sealant block, and a bottom in which is formed a lower sealant block outlet; and (B) a splash guard which is located above said outlet and which 1) automatically opens in response to sealant block ingress to permit passage of a sealant block therethrough and 2) automatically closes upon sealant block egress to prevent liquid sealant from splashing out of said splash box.

18. A splash box configured for mounting on a heated sealant tank of a sealant melter and for directing sealant blocks into an upper inlet of the sealant tank, said splash box comprising:

(A) an enclosure comprising a plurality of sidewalls, a top in which is formed a sealant block inlet, and a bottom in which is formed a lower sealant block outlet;

(B) a splash guard which is located above said outlet and which 1) automatically opens upon sealant block ingress to permit passage of a sealant block therethrough and 2) automatically closes upon sealant block egress to prevent liquid sealant from splashing out of said splash box; and wherein said splash guard comprises a pair of flaps which are mounted on said splash box so as to be pivotable about a horizontal axis 1) from a closed position in which they extend generally horizontally towards one another and separate said inlet from said outlet 2) to an open position in which they extend at an angle with respect to the horizontal and permit passage of said sealant blocks therepast, and a return mechanism which biases said flaps towards said closed position.

19. A sealant melter as defined in claim 18, wherein said return mechanism comprises a pair of counterweights, each of which is coupled to a respective one of said flaps.

20. A sealant melter as defined in claim 19, wherein said splash box further comprises a lid mounted on said splash box and pivotable from a first position covering said inlet to an open position exposing said inlet, and a manually-operated handle coupled to said lid, said handle extending downwardly from said lid to facilitate access by an operator standing on the ground.

21. A method of replenishing a supply of sealant to a heated sealant tank with a sealant block, the method comprising the steps of:

(A) providing a sealant melter including:

(1) a mobile frame, (2) a heated sealant tank mounted on said frame, said sealant tank having a liquid sealant discharge opening and an upper sealant block inlet opening, (3) a splash box disposed above said inlet opening of said sealant tank, said splash box having (a) an upper splash box inlet, (b) a lower splash box outlet disposed above said inlet opening of said sealant tank, and (c) at least one sidewall, said sidewall having a height that is larger than the length of the sealant block; and (B) placing the sealant block in said splash box inlet such that the sealant block completely enters the splash box before any part of the block exits said splash box and enters a pool of melted sealant filling said sealant tank so as to prevent liquid sealant from splashing out of said splash box inlet.

22. The method of claim 21, further comprising the step of: providing a splash guard mounted in said splash box, said splash guard being located intermediate said splash box outlet and said splash box inlet, and wherein said splash guard automatically opens in response to sealant block ingress to permit passage of the sealant block therethrough, and wherein said splash guard automatically closes before said sealant block enters the pool of melted sealant in said tank.

23. The method of claim 22, further comprising the steps of:

providing a towing vehicle mechanically coupled to said frame;

providing a storage location on said towing vehicle for storing the sealant block; and conveying, with an automatic conveyor, the sealant block from the storage location to said splash box inlet.

* * * * *